US009706795B2

(12) United States Patent
Boring

(10) Patent No.: US 9,706,795 B2
(45) Date of Patent: Jul. 18, 2017

(54) PIPE CLEANER

(71) Applicant: Amanda Boring, Alto, MI (US)

(72) Inventor: Amanda Boring, Alto, MI (US)

( * ) Notice: Subject to any disclaimer, the term of this patent is extended or adjusted under 35 U.S.C. 154(b) by 406 days.

(21) Appl. No.: 14/569,262

(22) Filed: Dec. 12, 2014

(65) Prior Publication Data

US 2015/0164135 A1 Jun. 18, 2015

Related U.S. Application Data

(60) Provisional application No. 61/915,902, filed on Dec. 13, 2013.

(51) Int. Cl.
*A24F 9/06* (2006.01)
*A24F 9/08* (2006.01)
*A24F 9/10* (2006.01)

(52) U.S. Cl.
CPC ..... *A24F 9/06* (2013.01); *A24F 9/08* (2013.01); *A24F 9/10* (2013.01)

(58) Field of Classification Search
CPC ..... A24F 9/08; A24F 9/10; A24F 9/12; A24F 9/06; A24F 9/04
USPC ..... D6/528, 534; 131/184
See application file for complete search history.

(56) References Cited

U.S. PATENT DOCUMENTS

| | | | | |
|---|---|---|---|---|
| 2,458,063 | A * | 1/1949 | Dulberg | A45D 34/06 132/314 |
| 2,790,448 | A * | 4/1957 | Bock | A24F 9/04 131/243 |
| D298,182 | S * | 10/1988 | Tarrson | D4/104 |
| 9,642,484 | B2 * | 5/2017 | Chang | A47G 21/06 |
| 2006/0280548 | A1 * | 12/2006 | Sharpe | A46B 5/0095 401/269 |
| 2007/0206988 | A1 * | 9/2007 | Washington | A45D 34/042 401/272 |
| 2013/0152318 | A1 * | 6/2013 | Felton, III | B08B 1/04 15/106 |

* cited by examiner

*Primary Examiner* — Anthony Calandra
(74) *Attorney, Agent, or Firm* — Dunlap Bennett & Ludwig PLLC

(57) ABSTRACT

A novel pipe cleaner is provided. The novel pipe cleaner may include a housing component providing an elongated tube that detachably secures a brush component on one end and a pick component on an opposing end. The brush component and the pick component may include elongated portions for scraping and cleaning the residue from a smoke pipe. The elongated portions can be simultaneously and interchangeably stored within the lumen of the elongated tube so as to facilitate the mess-free storage and portability of the novel pipe cleaner.

5 Claims, 1 Drawing Sheet

PIPE CLEANER

CROSS-REFERENCE TO RELATED APPLICATION

This application claims the benefit of priority of U.S. provisional application No. 61/915,902, filed 13 Dec. 2013, the contents of which are herein incorporated by reference.

BACKGROUND OF THE INVENTION

The present invention relates to pipe cleaning and, more particularly, to a mess-free pipe cleaner Smoking through a pipe causes residue that is caked on in hard to reach areas. This residue clogs the air flow through the pipe. This clogging makes the pipe ineffective for use. Cleaning the pipe is messy as the cleaning tools become caked with the same residue.

In general, traditional pipe cleaning methods are messy, inefficient and non-portable. Such cleaning tools get dirty, allowing residue to easily transfer onto the handle of the tool. As a result, there is no convenient way to store them or transport them after they have been used. Typical storing methods transfer the residue from the business end of the tool to the handle, assuming they even have a handle, causing dirty hands upon future uses. Additionally, the cleaning tools are usually left at home which causes inconvenience when the pipe smoker is away from home with a clogged/dirty pipe.

As can be seen, there is a need for a device allowing smokers to efficiently clean their pipes anywhere while keeping their hands and belongings clean, and where the device can be easily stored so as to not leave any residual mess while being stored or toted about.

SUMMARY OF THE INVENTION

In one aspect of the present invention, a device for facilitating the mess-free storage and portability of a pipe cleaner comprises: device for facilitating the mess-free storage and portability of a pipe cleaner, comprising: a brush component comprising: a brush handle portion, wherein the brush handle portion provides handle threading; and a neck portion extending from the brush handle portion on one end and having a plurality of bristles near an opposing end; a pick component comprising: a pick handle portion, wherein the pick handle portion provides handle threading; and a pick portion extending from the pick handle portion; and a housing component comprising an elongated tube having two opposing end openings for slidably receiving the brush component and the pick component, wherein each end opening has cooperating threading for detachably engaging the handle threading, and wherein the elongated tube is dimensioned to simultaneously receive the entirety of the pick portion and the neck portion, whereby the brush component and the pick component are configured to be interchangeably secured to either end opening.

In another aspect of the present invention, a system for facilitating the mess-free removal of blockage and extraction of residue from a smoking pipe comprises: a brush component comprising: a brush handle portion, wherein the brush handle portion provides handle threading; and a neck portion extending from the brush handle portion on one end and having a plurality of bristles near an opposing end, wherein the plurality of bristles are configured to remove blockage from a surface of the smoking pipe; a pick component comprising: a pick handle portion, wherein the pick handle portion provides handle threading; and a pick portion extending from the pick handle portion and terminating in a tapering pick, wherein the pick portion is configured to extract residue from a surface of the smoking pipe; and a housing component comprising an elongated tube having two opposing end openings for slidably receiving the brush component and the pick component, wherein each end opening has cooperating threading for detachably engaging the handle threading, and wherein the elongated tube is dimensioned to simultaneously receive the entirety of the pick portion and the neck portion, whereby the brush component and the pick component are configured to be interchangeably secured to either end opening.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a novel pipe cleaner providing mess-free storage and portability. The novel pipe cleaner may include a housing component providing an elongated tube that detachably secures a brush component on one end and a pick component on an opposing end. The brush component and the pick component may include elongated portions for scraping and cleaning the residue from a smoke pipe. The elongated portions can be simultaneously and interchangeably stored within the lumen of the elongated tube so as to facilitate the mess-free storage and portability of the novel pipe cleaner.

Figure 1:
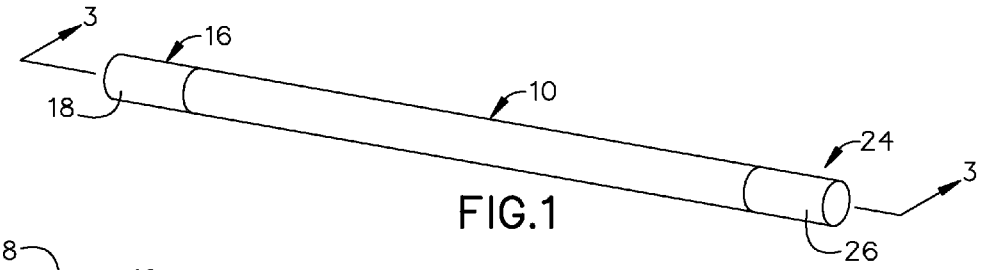
FIG. 1 is a perspective view of an exemplary embodiment of the present invention.
Figure 2:
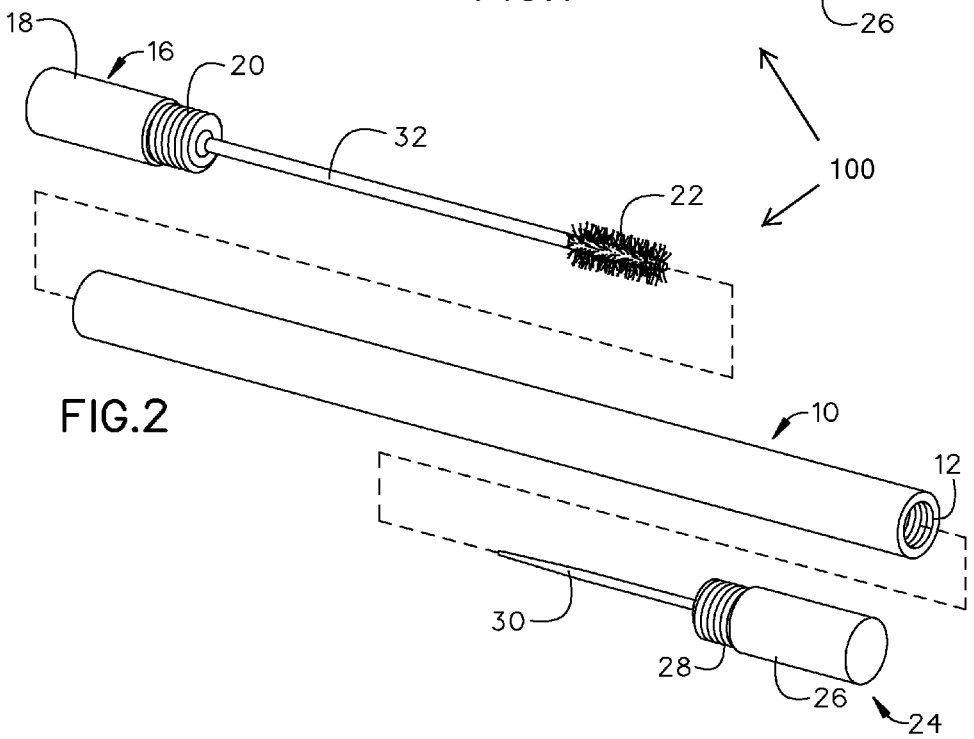
FIG. 2 is an exploded view of an exemplary embodiment of the present invention.
Figure 3:
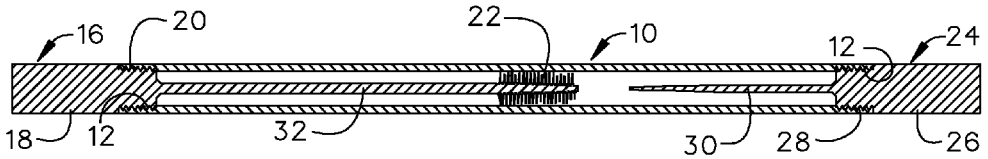
FIG. 3 is a section detail view of an exemplary embodiment of the present invention, taken along line 3-3 in FIG. 1.

Referring to FIGS. 1 through 3, the present invention may include a novel pipe cleaner 100 providing mess-free storage and portability. The pipe cleaner 100 may include a housing component 10, a brush component 16 and a pick component 24, each portion may be made of material that can be repeatedly bent without fracturing, such as polyethylene, polypropylene, vinyl, nylon, rubber, leather, various impregnated or laminated fibrous materials, various plasticized materials and the like. The housing component 10 may be an elongated tube with a first end and an opposing second end, each end having an opening communicating with the lumen formed by the elongated tube. Each opening and the lumen may be adapted to slidably receive the brush component 16 or the pick component 24, as illustrated in FIGS. 2 and 3.

The brush component 16 may include a handle portion 18 and a neck portion 32 extending therefrom. The brush component 16 may include a plurality of bristles 22 disposed near the end of the neck portion 32 opposite of the handle portion 18. The plurality of bristles 22 may be adapted to clean the inside walls of a smoking pipe and the bottom of the pipe's bowl by, in some embodiments, pushing and/or brushing the pipe's residue.

The pick component 24 may include a handle portion 26 and a tapering pick extending therefrom. The tapering pick may be adapted to clean the smoking pipe and the bottom of the pipe's bowl by, in some embodiments, removing lumps of burned and unburned smoking material that is inside the pipe and bowl after smoking.

The housing component 10 openings may be detachably secured to the pick component 24 and the brush potion 16 by a screw-threaded engagement for facilitating the mess-free storage and portability of the pipe cleaner 100. Each handle portion 18, 26 may provide threading 20, 28 that operatively engages cooperative threading 12 of along the lumen near each opening, as illustrated in FIGS. 2 and 3. The entirety of the neck portion 32 and the tapering pick may simultaneously be received in the lumen, as illustrated in FIG. 3. Either opening of the housing component 10 may detachably secure the pick component 24 or the brush potion 16 so as to be interchangeable to each.

A method of using the present invention may include the following. The novel pipe cleaner 100 disclosed above may be provided. After smoking a pipe, the user may unscrew the engaged threading 20, 12 to detach the brush component 16 for using the plurality of bristles 22 to scrape and clean portions of the pipe of residue and blockage. By re-engaging the same threading 20, 12 the brush component 16 may be re-secured to the housing component 10. Then the user may unscrew the engaged threading 28, 12 to detach the pick component 24 for using the tapering pick to scrape and clean portions of the pipe of residue and blockage. By re-engaging the same threading 28, 12 the pick component 24 may be re-secured to the housing component 10, wherein the residual mess is contained with its lumen, facilitating the mess-free storage and transportation of the novel pipe cleaner 100.

It should be understood, of course, that the foregoing relates to exemplary embodiments of the invention and that modifications may be made without departing from the spirit and scope of the invention as set forth in the following claims.

What is claimed is:

1. A device for facilitating the mess-free storage and portability of a pipe cleaner, comprising:

a brush component comprising:

a brush handle portion, wherein the brush handle portion provides handle threading; and a neck portion extending from the brush handle portion on one end and having a plurality of bristles near an opposing end;

a pick component comprising:

a pick handle portion, wherein the pick handle portion provides handle threading; and a pick portion extending from the pick handle portion; and a housing component comprising an elongated tube having two opposing end openings for slidably receiving the brush component and the pick component, wherein each end opening has cooperating threading for detachably engaging the handle threading, and wherein the elongated tube is dimensioned to simultaneously receive the entirety of the pick portion and the neck portion, whereby the brush component and the pick component are configured to be interchangeably secured to either end opening.

2. The device of claim 1, wherein the pick portion terminates in a tapering pick.

3. The device of claim 1, wherein the pick portion is configured to extract residue from a surface of a smoking pipe.

4. The device of claim 1, wherein the plurality of bristles are configured to remove blockage from a surface of a smoking pipe.

5. A system for facilitating the mess-free removal of blockage and extraction of residue from a smoking pipe, comprising:

a brush component comprising:

a brush handle portion, wherein the brush handle portion provides handle threading; and a neck portion extending from the brush handle portion on one end and having a plurality of bristles near an opposing end, wherein the plurality of bristles are configured to remove blockage from a surface of the smoking pipe;

a pick component comprising:

a pick handle portion, wherein the pick handle portion provides handle threading; and a pick portion extending from the pick handle portion and terminating in a tapering pick, wherein the pick portion is configured to extract residue from a surface of the smoking pipe; and a housing component comprising an elongated tube having two opposing end openings for slidably receiving the brush component and the pick component, wherein each end opening has cooperating threading for detachably engaging the handle threading, and wherein the elongated tube is dimensioned to simultaneously receive the entirety of the pick portion and the neck portion, whereby the brush component and the pick component are configured to be interchangeably secured to either end opening.

* * * * *